US008970109B2

(12) United States Patent
Sasai et al.

(10) Patent No.: US 8,970,109 B2
(45) Date of Patent: Mar. 3, 2015

(54) METAL HALIDE LAMP AND LIGHTING APPARATUS

(75) Inventors: Yasushi Sasai, Gyoda (JP); Kanae Matsumoto, Gyoda (JP)

(73) Assignee: Iwasaki Electric Co., Ltd., Chuo-Ku, Tokyo (JP)

( * ) Notice: Subject to any disclaimer, the term of this patent is extended or adjusted under 35 U.S.C. 154(b) by 0 days.

(21) Appl. No.: 14/119,267

(22) PCT Filed: Jul. 26, 2011

(86) PCT No.: PCT/JP2011/066921

§ 371 (c)(1),
(2), (4) Date: Nov. 21, 2013

(87) PCT Pub. No.: WO2013/014746

PCT Pub. Date: Jan. 31, 2013

(65) Prior Publication Data

US 2014/0078745 A1 Mar. 20, 2014

(51) Int. Cl.

| | |
|---|---|
| ***H01J 61/62*** | (2006.01) |
| ***H01J 61/12*** | (2006.01) |
| ***H01J 61/34*** | (2006.01) |
| *F21V 7/00* | (2006.01) |
| *F21V 23/02* | (2006.01) |

(52) U.S. Cl.

CPC ..... *H01J 61/125* (2013.01); *H01J 61/34* (2013.01); *F21V 7/00* (2013.01); *F21V 23/026* (2013.01)

USPC ..... 313/640

(58) Field of Classification Search

None

See application file for complete search history.

(56) References Cited

U.S. PATENT DOCUMENTS

| | | | |
|---|---|---|---|
| 7,245,075 | B2 | 7/2007 | Chen et al. |
| 7,671,537 | B2 | 3/2010 | Geijtenbeek et al. |
| 8,350,477 | B2 | 1/2013 | Maehara et al. |
| 2008/0224615 | A1 | 9/2008 | Higashi et al. |

FOREIGN PATENT DOCUMENTS

| | | |
|---|---|---|
| JP | 2005-135604 | 5/2005 |
| JP | 2006-294620 | 10/2006 |
| JP | 2007-053004 | 3/2007 |

(Continued)

OTHER PUBLICATIONS

Notification of Transmittal of Copies of Translation of the International Preliminary Report on Patentability (Application No. PCT/JP2011/066921) dated Jan. 30, 2014.

(Continued)

*Primary Examiner* — Britt D Hanley

(74) *Attorney, Agent, or Firm* — Eric J. Robinson; Robinson Intellectual Property Law Office, P.C.

(57) ABSTRACT

Provided is a metal halide lamp having a ceramics arc tube, wherein a rated power is 35 to 100 W and a color temperature is 2800 to 3700 K, wherein halogen additives as light emission materials are included in the arc tube, wherein the halogen additives consists of (1) cerium (Ce); (2) sodium (Na); (3) calcium (Ca); (4) thallium (Tl); and (5) rare earth metal comprising at least one of dysprosium (Dy), thulium (Tm), and holmium (Ho), and the halogen additives are iodide compounds, wherein, for respective composition ratios of the halogen additives for (1) to (4), cerium iodide is 1.5 mol % to 3.0 mol %; sodium iodide is 45 mol % to 90 mol %; calcium iodide is 5 mol % to 15 mol %; and thallium iodide is 2 mol % to 7 mol %.

3 Claims, 7 Drawing Sheets

(56) References Cited

FOREIGN PATENT DOCUMENTS

| | | |
|---|---|---|
| JP | 2007-528110 | 10/2007 |
| JP | 2010-251252 | 11/2010 |
| WO | 2005/096347 | 10/2005 |

OTHER PUBLICATIONS

International Search Report for Application U.S. Appl. No. PCT/JP2011/066921 dated Aug. 23, 2011.

METAL HALIDE LAMP AND LIGHTING APPARATUS

BACKGROUND OF THE INVENTION

1. Technical Field

The present invention relates to, in general, a metal halide lamp and a lighting apparatus and, in particular, a metal halide lamp with a low color temperature having a ceramics arc tube and a lighting apparatus using the metal halide lamp.

2. Background Art

Metal halide lamps are used not only for the base lighting as a down light but also for the spot lighting for directly illuminating items in a commercial facility such as the store lighting. In the spot lighting, higher optical characteristics is required than in the base lighting. Specifically, the required characteristics is that the Ra (general color rendering index) is 90 or more, the R9 (special color rendering index) is 50 or more, the color temperature is 2800 to 3700 K, and the Duv (illuminant color (tinge)) is −5 to 0.

Further, the increased efficiency is desired for the spot lighting as well as the base lighting in terms of energy saving.

For example, while the efficiencies of the commercially available lamps are 90 ml/W for rated power 35 W, 95 ml/W for 70 W, and 100 ml/W for 100 W, the demanded efficiencies are increased up to 95 ml/W for rated power 35 W, 100 ml/W for 70 W, and 110 ml/W for 100 W.

In general, in the ceramic metal halide lamp, there is a tradeoff relationship between high color-rendering and high efficiency, and therefore it has been difficult to improve both of them at the same time.

Patent document 1 discloses a ceramic metal halide lamp with the low color temperature type (2800 to 3700 K). Patent document 1 discloses that the light emission material (halogen iodide) sealed in the lamp contains a composition ratio of 0.5 to 4 mol % of cerium or praseodymium (for example, 2 mol % of cerium), a composition ratio of 35 to 45 mol % of sodium (for example, 35 mol %), a composition ratio of 40 to 60 mol % of calcium (for example, 54 mol %), 2 mol % of thallium, and a composition ratio of 2 to 10 mol % of rare earth metal including dysprosium, thulium, or holmium (for example, 7 mol % of the rare earth metal comprising the above three materials). It is disclosed that the above design results in that the efficiency is 94 lm/W, the Ra is 90 or more, the R9 is 40 or more, and the lower limit of the Duv value is −10, and this specification can be applied to the lamp of the rated power of 20 to 300 W. In particular, it is generally known that the composition ratio of calcium is increased in order to improve the R9, and the above composition is based on this knowledge.

PRIOR ART DOCUMENT

Patent Document

Patent Document 1: Japanese Patent Application Laid-open No. 2007-53004

SUMMARY OF THE INVENTION

Technical Problem

Although the above document discloses the embodiment for the rated power of 150 W, the same effect and advantage cannot be obtained in practice when the above specification is applied to the lamp of the rated power of 100 W or less (in particular, the R9 above 40 cannot be achieved). It is considered that this is because the ratio of the heat loss from the capillary at the end of the arc tube in the lamp of 100 W class or less is greater than that in the lamp of 150 W class.

Therefore, the object of the present invention is to provide a metal halide lamp that has the color rendering property that the Ra is 90 or more and the R9 is 50 or more, the color temperature 2800 to 3700 K, and the illuminant color (tinge) property that the lower limit of the Duv is −5 and the upper limit is 0, and meets the demand for the increased efficiency as described above.

Solution to the Problem

The first aspect of the present invention is a metal halide lamp having a ceramics arc tube, wherein a rated power is 35 to 100 W and a color temperature is 2800 to 3700 K, wherein halogen additives as light emission materials are included in the arc tube, wherein the halogen additives consists of (1) cerium (Ce); (2) sodium (Na); (3) calcium (Ca); (4) thallium (Tl); and (5) rare earth metal comprising at least one of dysprosium (Dy), thulium (Tm), and holmium (Ho), and the halogen additives are iodide compounds, wherein, for respective composition ratios of the halogen additives for (1) to (4), cerium iodide is greater than or equal to 1.5 mol % and less than or equal to 3.0 mol %; sodium iodide is greater than or equal to 45 mol % and less than or equal to 90 mol %; calcium iodide is greater than or equal to 5 mol % and less than or equal to 15 mol %; and thallium iodide is greater than or equal to 2 mol % and less than or equal to 7 mol %.

Further, cerium iodide may be greater than or equal to 1.9 mol % and less than or equal to 2.3 mol %; sodium iodide may be greater than or equal to 76 mol % and less than or equal to 79 mol %; calcium iodide maybe greater than or equal to 11 mol % and less than or equal to 13.5 mol %; and thallium iodide may be greater than or equal to 3 mol % and less than or equal to 3.7 mol %.

The second aspect of the present invention is a lighting apparatus including the metal halide lamp of the above first aspect and a reflector to which the metal halide lamp is attached.

DETAILED DESCRIPTION OF THE EMBODIMENTS

Figure 1:
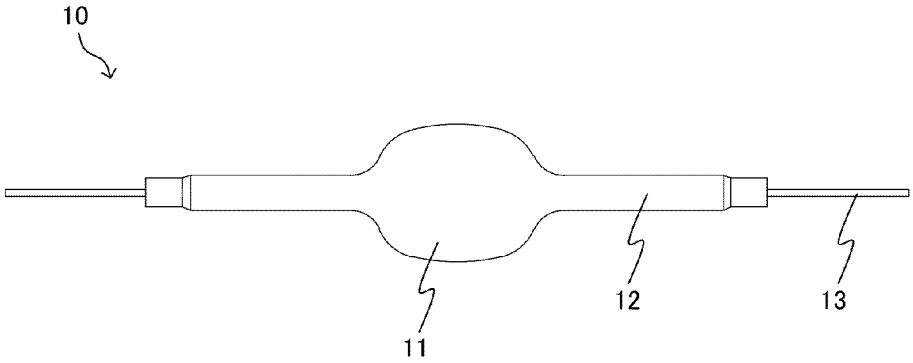
FIG. 1 is a view of the arc tube used in a metal halide lamp of the present invention.

FIG. 1 illustrates an arc tube 10 used in a metal halide lamp of the present invention. As illustrated, the ceramic arc tube 10 (alumina pipe) has a main tube portion 11 and thin tube portions 12 that are integrally formed. That is, with the continuous forming of the main tube portion 11 and the thin tube portions 12, no discontinuity in thickness occurs at their boundaries. A pair of electrodes (not shown) are arranged so as to oppose to each other within the main tube portion 11, and each of these electrodes is connected to a lead 13 via an electric conductor inside the thin tube portion 12. Such integrated forming type arc tube has a quite smaller heat loss at the ends of the main tube portion 11 than the cylindrical type (assembly type) arc tube (see FIG. 3 of Patent document 1), which contributes to the improved efficiency. In particular, this tendency is more notable in the low watt type in which the ratio of the end parts is larger than the main tube portion.

Figure 2:
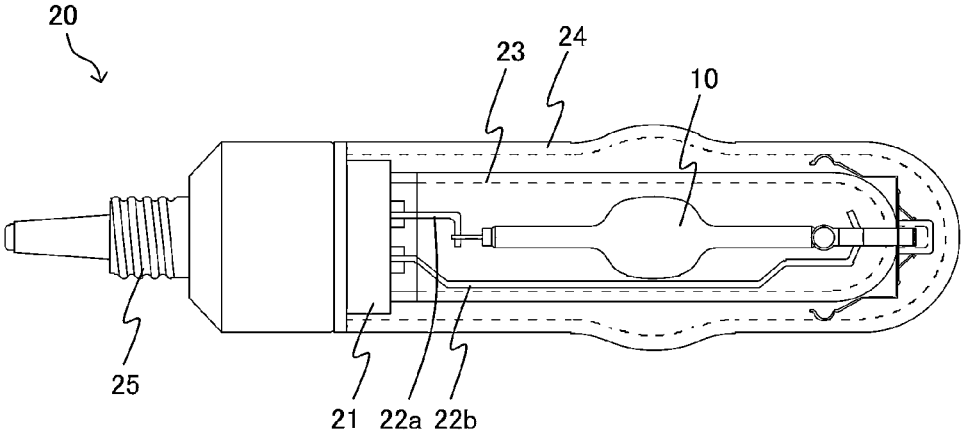
FIG. 2 is a view of the metal halide lamp to which the present invention is applied.

FIG. 2 illustrates a metal halide lamp 20 (hereafter, referred to as "lamp 20") to which the present invention is applied. In the lamp 20, the arc tube 10 is connected to abase 21 by electric conducting rods 22*a* and 22*b* and included inside an inner bulb 23, and the inner bulb 23 is included in an outer bulb 24. The inner bulb 23 and the outer bulb 24 are fixed to the base 21, and the base 21 is provided with a shell 25. It is noted that, although not shown, one of the conducting rods 22*a* and 22*b* is electrically connected to the tip of the base 21 and the other is electrically connected to the side of the shell 25.

Light emission material and argon gas are contained in the main tube portion 11 of the arc tube 10. The light emission material comprises mercury and halogen compound, and the halogen compound consists of (1) cerium (Ce), (2) sodium (Na), (3) calcium (Ca), (4) thallium (Tl), and (5) rare earth metal (hereafter, referred to as "other component") comprising at least one of dysprosium (Dy), thulium (Tm), and holmium (Ho), and all of the above halogen additives are the iodide compound. The present invention is to optimize, in particular among the above, the inclusion amount (the composition ratio) of cerium iodide ($CeI_3$), sodium iodide (NaI), calcium iodide ($CaI_2$), and thallium iodide (TlI).

Determination of the composition ratios of the above-described four components will be described below.

The reference composition ratios of cerium iodide ($CeI_3$), sodium iodide (NaI), calcium iodide ($CaI_2$), and thallium iodide (TlI) are approximately 2 mol %, 76 mol %, 14 mol %, and 4 mol %, respectively, and respective components are then increased or reduced to measure its influence to respective properties. It is noted that the rest of the above mol % (approximately 4%) corresponds to the composition ratio of the iodide compound of other component.

The arc tube is 70 W type and the internal volume of the arc tube is 0.4 cc. The additive amount per unit volume is 16.3 mg/cc and thus the total additive amount is 6.5 mg. It is noted that the inclusion amount of mercury is 6 mg.

Each measurement value is a value at the time when 100 hours have elapsed from the ignition.

<Determination of Amount of Cerium Iodide ($CeI_3$)>

Figure 3A:
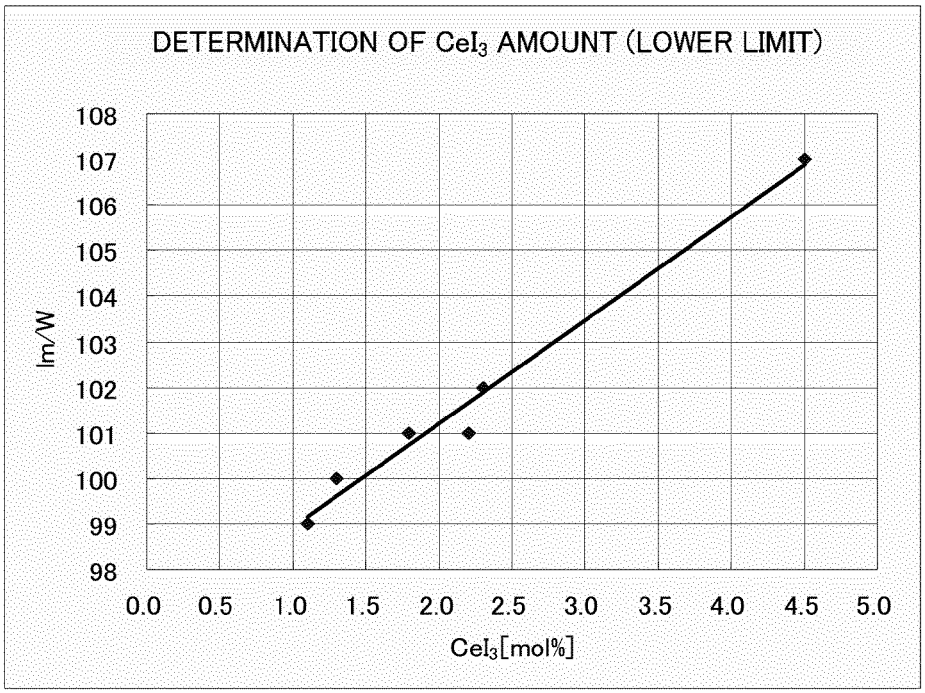
FIG. 3A is a view illustrating determination of the amount of iodide cerium according to the present invention.

The amount of cerium iodide influences the luminous efficiency and the illuminant color (Duv) of green. FIG. 3A illustrates a graph of the luminous efficiency to the cerium iodide. Greater amount of cerium iodide allows for the increased luminous efficiency. Here, in order to achieve the luminous efficiency of 100 lm/W or more, the amount of the cerium iodide is required to be greater than or equal to 1.5 mol %.

Figure 3B:
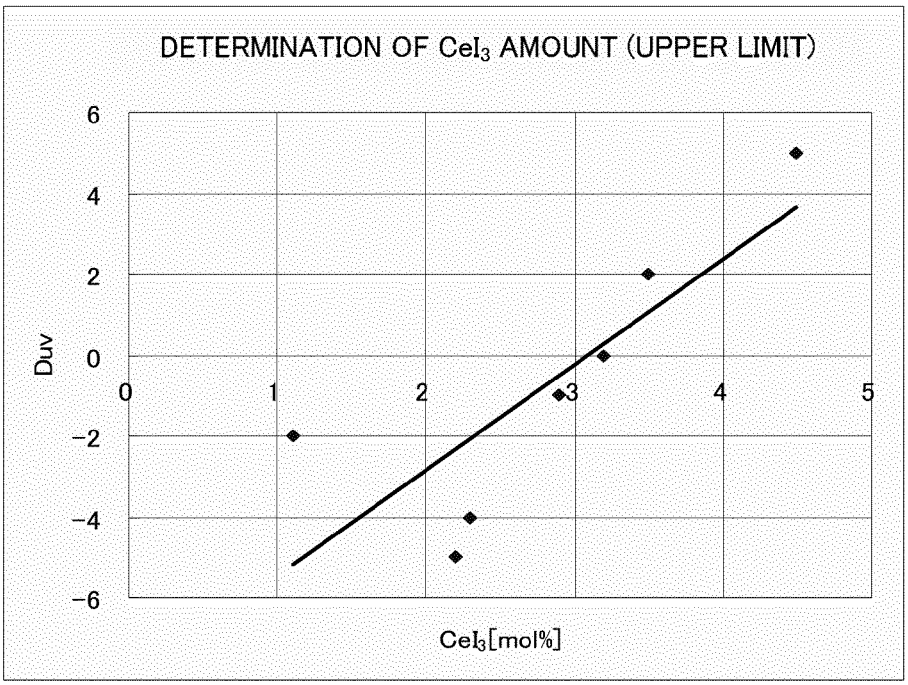
FIG. 3B is a view illustrating determination of the amount of iodide cerium according to the present invention.

FIG. 3B illustrates a graph of the Duv to the amount of cerium iodide. The Duv increases in a monotonic manner with respect to the amount of cerium iodide. Here, the amount of cerium iodide is required to be 1.0 to 3.0 mol % so that Duv is −5 to 0.

Therefore, the amount of cerium iodide can be determined to be 1.5 to 3.0 mol %.

<Determination of Amount of Sodium Iodide (NaI)>

Figure 4:
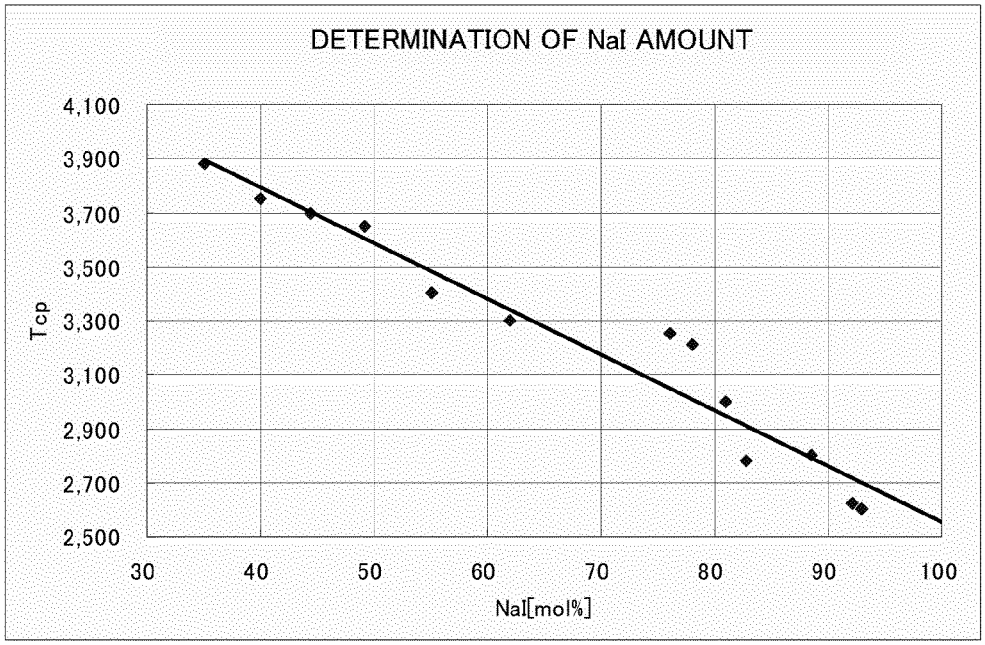
FIG. 4 is a view illustrating determination of the amount of iodide sodium according to the present invention.

The amount of sodium iodide influences the color temperature (Tc). FIG. 4 illustrates a graph of the color temperature to the amount of sodium iodide. The color temperature decreases in a monotonic manner with respect to the amount of sodium iodide. Here, the amount of sodium iodide can be determined to be 45 to 90 mol % so that the color temperature is 2800 to 3700 K.

<Determination of Amount of Calcium Iodide ($CaI_2$)>

Figure 5A:
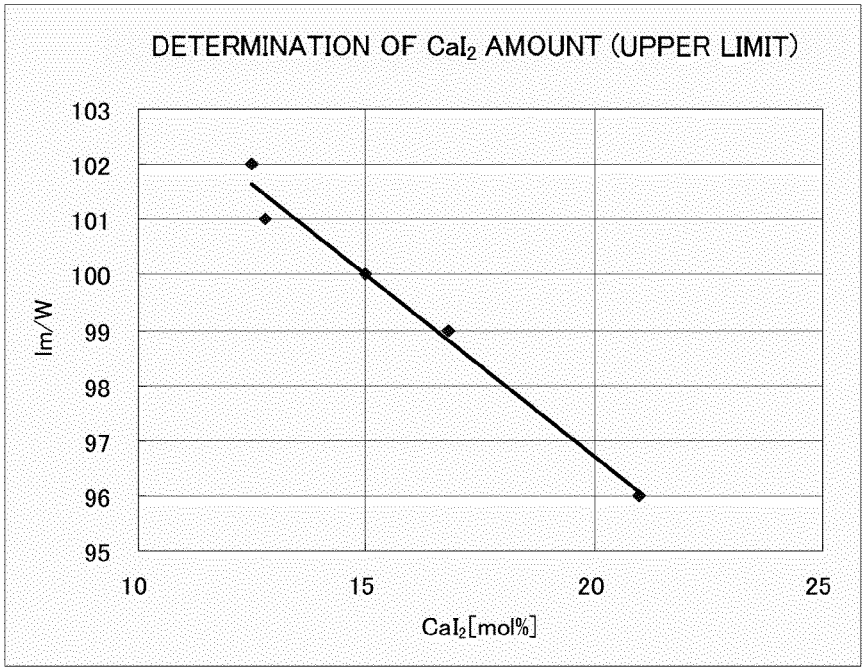
FIG. 5A is a view illustrating determination of the amount of iodide calcium according to the present invention.

The amount of calcium iodide influences the luminous efficiency and the red property (R9). FIG. 5A illustrates a graph of the luminous efficiency to the amount of calcium iodide. Greater amount of calcium iodide results in lower luminous efficiency. Here, in order to achieve the luminous efficiency of 100 lm/W or more, the amount of calcium iodide is required to be less than or equal to 15 mol %.

Figure 5B:
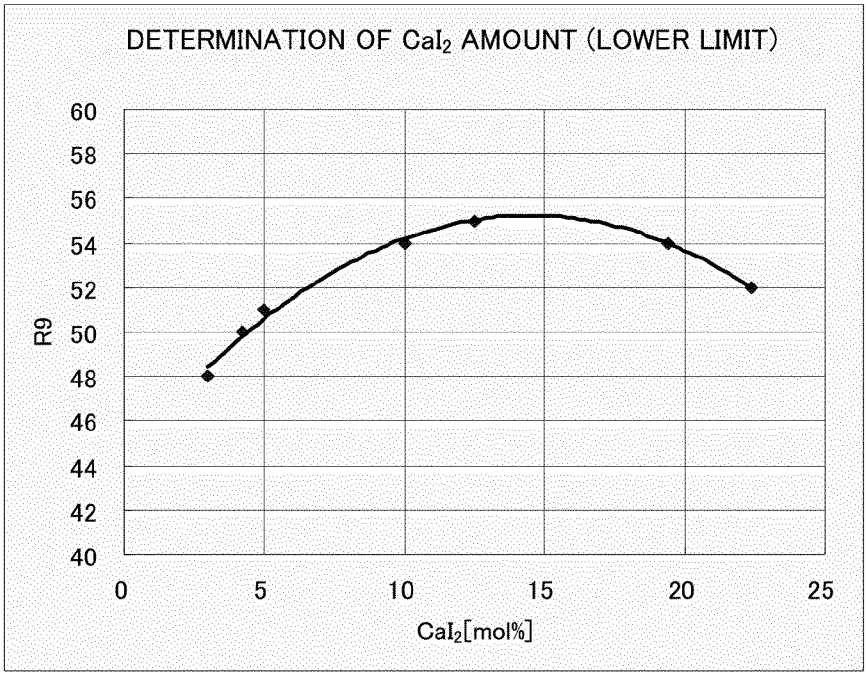
FIG. 5B is a view illustrating determination of the amount of iodide calcium according to the present invention.

FIG. 5B illustrates a graph of the value of the R9 to the amount of calcium iodide. The graph exhibits an upward convex curve and, here, in order to achieve the R9 greater than or equal to 50, the amount of calcium iodide is required to be greater than or equal to 5 mol %.

Therefore, the amount of calcium iodide can be determined to be 5 to 15 mol %.

<Determination of Amount of Thallium Iodide (TlI)>

The amount of thallium iodide influences the illuminant color (Duv) of pink.

Figure 6:
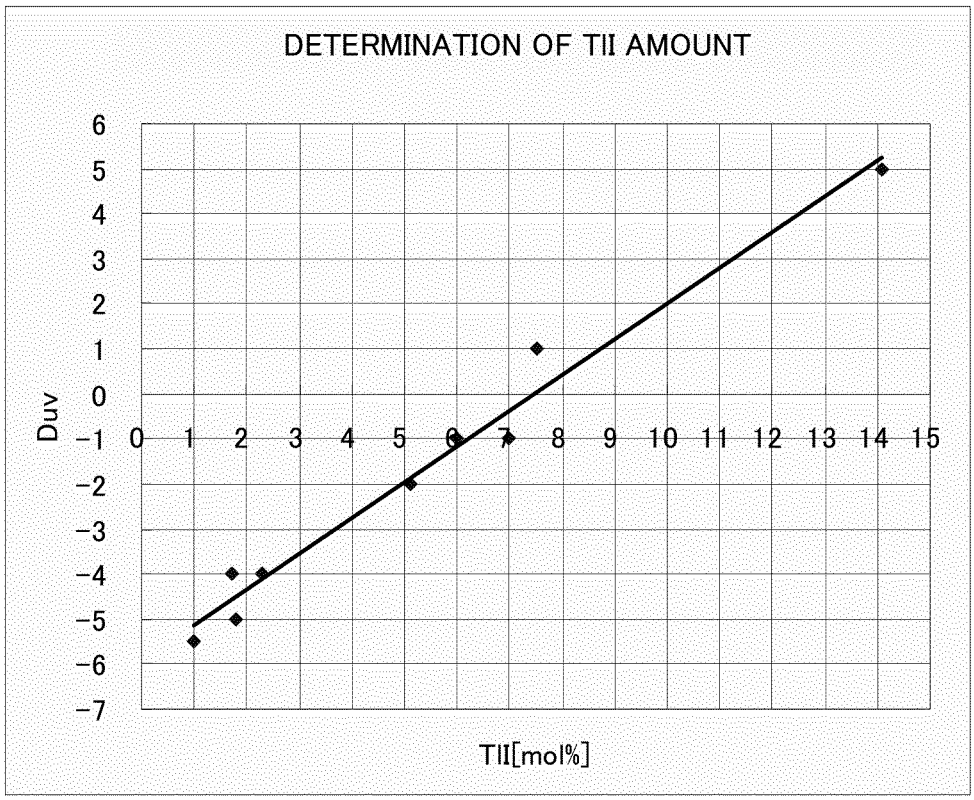
FIG. 6 is a view illustrating determination of the amount of iodide thallium according to the present invention.

FIG. 6 illustrates a graph of the Duv to the amount of thallium iodide. The Duv increases in a monotonic manner with respect to the amount of thallium iodide. Here, the amount of thallium iodide can be determined to be 2.0 to 7.0 mol % so that Duv is −5 to 0.

As described above, respective composition ratios have been determined as follows:

cerium iodide: greater than or equal to 1.5 mol % and less than or equal to 3.0 mol %;

sodium iodide: greater than or equal to 45 mol % and less than or equal to 90 mol %;

calcium iodide: greater than or equal to 5 mol % and less than or equal to 15 mol %; and thallium iodide: greater than or equal to 2 mol % and less than or equal to 7 mol %.

What is notable here is that the amount of calcium iodide is quite smaller and the amount of sodium iodide is greater compared to the specification in Patent document 1. In particular, the arc tube 10 is formed in the integrated forming type, so that the desired luminous efficiency can be obtained even when the amount of calcium iodide is reduced. It is thus understood that, with the luminous efficiency being maintained, the improvement of the R9 is achieved by the reduction of the amount of calcium iodide. This allows for both high efficiency and high color rendering at the same time, resulting in significant improvement of the balance and its absolute value of the luminous efficiency and the luminous property such as the color rendering property.

Examples based on the above discussion will be described below. Table 1 shows examples of the lamps (70 W, 35 W, and 150 W types) fabricated according to the above. The wall surface load of the arc tube is 20 to 40 W/cm$^2$ and the argon gas of 20 kPA (150 Torr) is included as other factor than are indicated in Table 1. Further, the rest of the mol % for the above four components corresponds to the composition ratio of the iodide compound of other component. It is noted that the measurement values for respective properties are the values obtained at the time when 100 hours have elapsed after the ignition.

TABLE 1

| specification | | unit | determined range | 70 W Examples 1 | 2 | 3 | 35 W 4 | 100 W 5 |
|---|---|---|---|---|---|---|---|---|
| composition ratio | $CeI_3$ | mol % | 1.5 to 3 | 2.3 | 2.0 | 1.9 | 1.9 | 1.9 |
| | NaI | mol % | 45 to 90 | 76.0 | 79.1 | 77.3 | 77.3 | 77.3 |
| | $CaI_2$ | mol % | 5 to 15 | 11.3 | 11.3 | 11.0 | 11.0 | 11.0 |
| | TlI | mol % | 2 to 7 | 3.7 | 3.1 | 3.0 | 3.0 | 3.0 |
| arc tube inner volume | | cc | | | 0.4 | | 0.15 | 0.75 |
| total additive amount | | mg | — | 6.5 | 7.5 | 8.3 | 8.3 | 7.8 |
| additive amount per vol | | mg/cc | — | 16.3 | 18.8 | 20.8 | 55.3 | 10.4 |
| mercury amount | | mg | — | 6 | 6 | 6 | 3.6 | 10 |

| measured item | unit | Target value | Examples 1 | 2 | 3 | 4 | 5 |
|---|---|---|---|---|---|---|---|
| LPW | lm/W | 100 or more | 104 | 100 | 102 | 96 | 113 |
| Tcp | K | 2800 to 3700 | 3080 | 2860 | 3190 | 2900 | 2980 |
| DUV | — | −5 to 0 | 0 | −5 | −3 | −3 | −4 |
| Ra | — | 90 or more | 92 | 93 | 94 | 91 | 93 |
| R9 | — | 50 or more | 52 | 50 | 52 | 50 | 57 |

As shown in Table 1, the target luminous efficiency and optical property were satisfied in all the examples by setting the composition ratios of cerium iodide ($CeI_3$), sodium iodide (NaI), calcium iodide ($CaI_2$), and thallium iodide (TlI) to be included in respective determined ranges.

Figure 7:
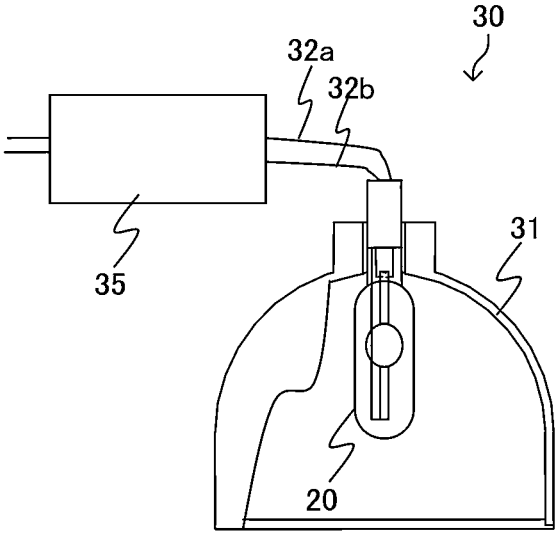
FIG. 7 is a view of a lighting apparatus of the present invention.

FIG. 7 illustrates a lighting apparatus 30 in which the above-described metal halide lamp is used. The lighting apparatus 30 includes the lamp 20 and a reflector 31 to which the lamp 20 is attached, and is connected to a high pressure discharge lamp ballast 35 via wirings 32*a* and 32*b*. It is noted that the ballast 35 and the lighting apparatus 30 may be integrated, or maybe separated. Further, the drawing depicts the embodiment in a schematic manner, and the size, the position, and the like in the actual implementation may not be the same as the drawing.

The above disclosure allows for configuring the lighting apparatus comprising the lamp that is superior in the luminous efficiency and the optical property and for providing the lighting apparatus suitable for the spot lighting in the store lighting and the like.

Reference Numerals

10 arc tube
11 main tube portion
12 thin tube portion
13 lead
20 metal halide lamp
21 base
22*a*, 22*b* conducting rod
23 inner bulb
24 outer bulb
25 shell
30 lighting apparatus
31 reflector
32*a*, 32*b* wiring
35 high pressure discharge lamp ballast

The invention claimed is:

1. A metal halide lamp comprising a ceramics arc tube, wherein a rated power is 35 to 100 W and a color temperature is 2800 to 3700 K, wherein halogen additives as light emission materials are included in the arc tube, wherein the halogen additives consists of (1) cerium (Ce); (2) sodium (Na); (3) calcium (Ca); (4) thallium (Tl); and (5) rare earth metal comprising at least one of dysprosium (Dy), thulium (Tm), and holmium (Ho), and the halogen additives are iodide compounds, wherein, for respective composition ratios of the halogen additives for (1) to (4), cerium iodide is greater than or equal to 1.5 mol % and less than or equal to 3.0 mol %;

sodium iodide is greater than or equal to 45 mol % and less than or equal to 90 mol %;

calcium iodide is greater than or equal to 5 mol % and less than or equal to 15 mol %; and thallium iodide is greater than or equal to 2 mol % and less than or equal to 7 mol % so that special color rendering index R9 is 50 or more.

2. The metal halide lamp according to claim 1, wherein cerium iodide is greater than or equal to 1.9 mol % and less than or equal to 2.3 mol %;

sodium iodide is greater than or equal to 76 mol % and less than or equal to 79 mol %;

calcium iodide is greater than or equal to 11 mol % and less than or equal to 13.5 mol %; and thallium iodide is greater than or equal to 3 mol % and less than or equal to 3.7 mol %.

3. A lighting apparatus comprising the metal halide lamp according to claim 1 and a reflector to which the metal halide lamp is attached.

* * * * *